US006668841B1

(12) United States Patent
Chou

(10) Patent No.: US 6,668,841 B1
(45) Date of Patent: Dec. 30, 2003

(54) HAIR CLIP

(76) Inventor: Kuo Hua Chou, No. 6, Wuchuan 8th Rd., Wuku Hsiang, Taipei Hsien (TW)

( * ) Notice: Subject to any disclaimer, the term of this patent is extended or adjusted under 35 U.S.C. 154(b) by 0 days.

(21) Appl. No.: 10/217,450

(22) Filed: Aug. 14, 2002

(51) Int. Cl.[7] ..... A45D 8/22
(52) U.S. Cl. ..... 132/278
(58) Field of Search ..... 132/276, 277, 132/278, 279, 273, 275

(56) References Cited

U.S. PATENT DOCUMENTS 5,109,878 A * 5/1992 Kuo-Hua ..... 132/279
5,758,672 A * 6/1998 Chou ..... 132/275
5,816,267 A * 10/1998 Chou ..... 132/275
6,311,699 B1 * 11/2001 Horman ..... 132/278
6,311,700 B1 * 11/2001 Yeh ..... 132/279
6,378,532 B1 * 4/2002 Chou et al. ..... 132/279

* cited by examiner

*Primary Examiner*—Todd E. Manahan
(74) *Attorney, Agent, or Firm*—Rosenberg, Klein & Lee

(57) ABSTRACT

Present invention relates to a hair clip that mainly comprises: a base plate and an upper clip plate. Multiple equally spaced curved strips are equipped along the length of base plate. Such curved strips further form multiple rooms on base plate. Application of present invention allows hairs to be distributed evenly within the rooms and clips hairs firmly between upper clip plate and base plate to prevent hairs from distortion and damage. In addition, by eliminating middle clip plate the production cost is lowered.

10 Claims, 8 Drawing Sheets

HAIR CLIP

BACKGROUND OF THE INVENTION

Present invention particularly relates to a hair clip which provides even hair Distribution in all directions. Such hair clip will not fall off from hair easily and also provides protection against hair damage, Common hair clip (refer to FIGS. 13 to 15) comprises at least base plate (6), upper clip plate (7), middle clip plate (8), and other components. As said hair clip clips, curved pressure strip (71) at the center of upper clip plate (7) tightly presses hairs (5) into hallow center (81) of middle clip plate (8) to achieve solid clipping effect. Regardless of the amount of hairs (5) being clipped, common hair clip fails to allocate hairs (5) evenly for the following reasons:

1. The clipping space between upper clip plate (7) and middle clip plate (8) is very limited at the center but more spacious at both ends. Consequently more hairs (5) are allocated at both ends.
2. The curvature of curved pressure strips (71) of both middle clip plate (8) and upper clip plate (7) are in opposite direction.

As shown in FIG. 15, majority portions of hairs (5) are twisted and damaged as common hair clip clips. As the contact area between hairs (5) and hair clip is limited, the hair clip may fall off very easily.

In addition, the production of middle clip plate (8) requires forming, which further increases production cost. Also, middle clip plate (8) can be dismantled easily. Hence it has a potential risk of being accidentally swallowed by children.

ABSTRACT OF INVENTION

Present invention aims to simplify hair clip structure and to improve clipping effect.

To achieve said objectives, present invention comprises a base plate and a upper clip plate. At base plate, multiple hair allocation mechanisms are quipped along the length of the hair clip. Also, multiple corresponding curved strips or downwardly convex tapers can be equipped at upper clip plate.

Components of said mechanism can include one of the following options:

a). multiple equally spaced curved strips which further form multiple rooms on base plate.

b). multiple convex tapers at base plate and a curved pressure strip at the center of upper clip plate.

Present invention should enjoy following benefits:

1. Hair allocation mechanisms would distribute hairs evenly within hair clip; thus protects hair structure from damage and also improves clipping effect.
2. Elimination of middle clip plate simplifies hair clip structure and also lowers production cost.
3. Risk of children dismantle middle clip plate is eliminated.

Please refer to the following figure and detailed application description for better understanding.

TABLE OF LEGENDS

| | |
|---|---|
| Base plate: | (1),(3),(6) |
| Pressure strips: | (11),(31) |
| Hooks: | (111),(311) |
| Pivot plate: | (12),(32) |
| Coupling hole: | (121),(321) |
| Curved Strips: | (13),(23),(33) |
| Rooms: | (131),(231),(331) |
| Support Strips: | (14),(24),(33) |
| Upper clip plate: | (2),(4),(7) |
| Rough pattern | (20) |
| Pivot pin: | (21),(41) |
| Buckling hole: | (22),(42) |
| Downwardly convex Tapers | (25) |
| Circular end | (26) |
| Connection Strip | (332) |
| Curved pressure strip | (43),(71) |
| Downwardly convex curve strip | (44) |
| Hairs | (5) |
| Middle clip plate | (8) |
| Hallow Center | (81) |

DETAILED DESCRIPTION OF APPLICATIONS

Figure 1:
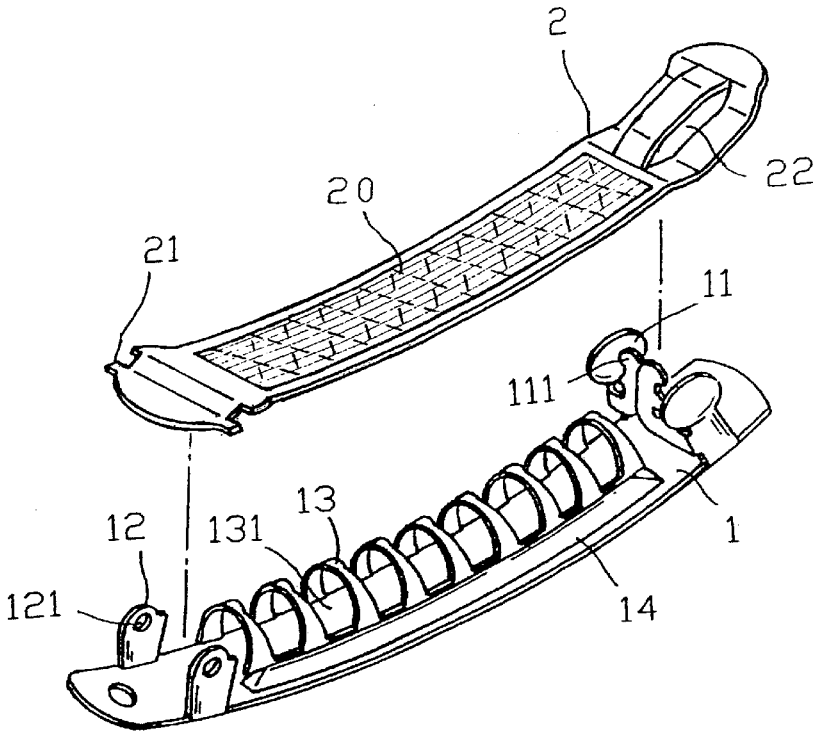
FIG. 1 is a three-dimensional decomposition of $1^{st}$ application of present invention.

FIG. 1 illustrates $1^{st}$ application of present invention. Said application comprises base plate (1), wherein two corresponding pressure strips (11) are equipped at one lateral end. Each of said pressure strips (11) further equip with an inwardly extended hook. Both sides of another end comprise pivot plates (12), each of which further encompasses a coupling hole (121). One lateral end of upper clip plate (2) equips with a pivot pin (21) on both sides. The attachment of pivot pin (21) to coupling hole (121) connects upper clip plate (2) to base plate (1). Other end of upper clip plate (2) can open and close freely. Such end equips with a buckling hole (22) to buckle hooks (111) of base plate (1).

Multiple equally spaced curved strips (13) (hair allocation mechanisms) are equipped on one side of base plate (1) which further forms multiple rooms (131). A support strip

Figure 2:
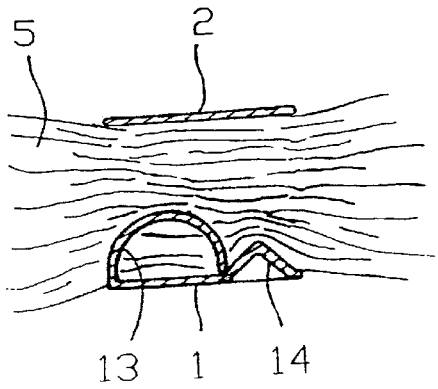
FIG. 2 demonstrates $1^{st}$ application of present invention in using state.

(14) is equipped on other side of base plate (1). One end of curved strips (13) reaches against the inner side of support strip (14) to prevent edge of curved strips from cutting user's finger. Upper clip plate (2) further equips with a series of rough pattern (20) to enhance clipping effect (as shown in FIG. 2), reduce hair distortion and damage, and increase bending strength of upper clip plate (2).

Figure 3:
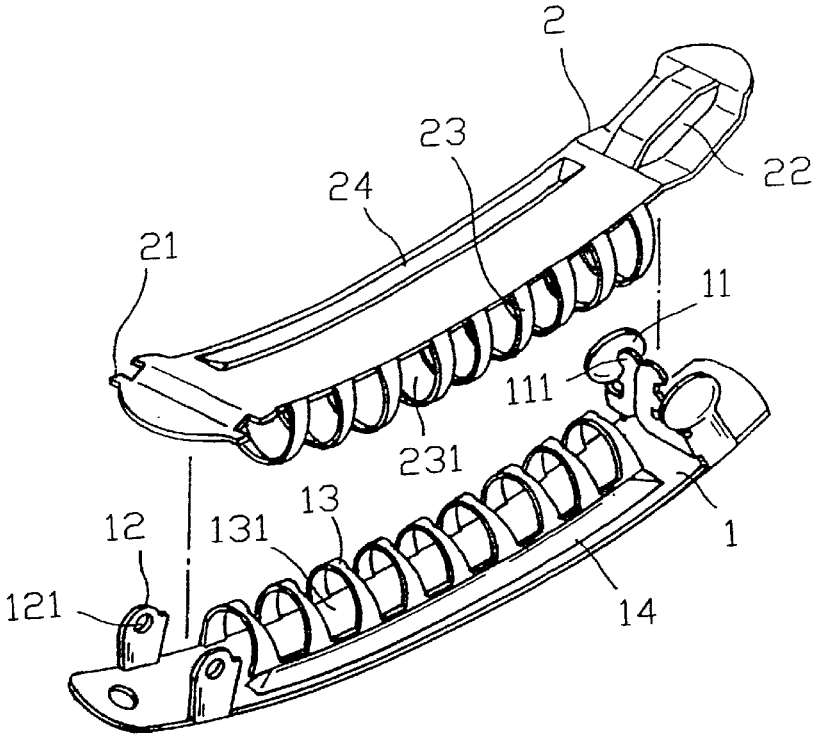
FIG. 3 is a three-dimensional decomposition of $2^{nd}$ application.
Figure 4:
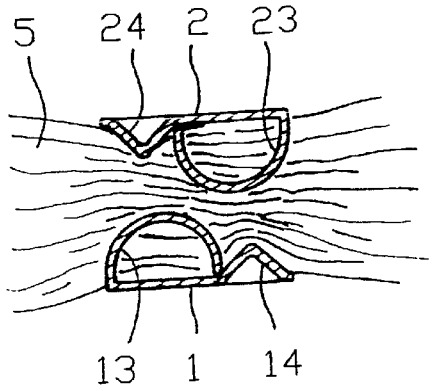
FIG. 4 demonstrates $2^{nd}$ application of present invention in using state.

In addition, at the side of upper clip plate (2) which corresponds to support strip (14) of base plate (1), similar curved strips (23) are equipped (shown in FIG. 3, 4). At other side of upper clip plate (2) also equips with support strip (24). One end of curved strips (23) reaches against the inner side of support strip (24).

In actual application, shape of base plate (1) and upper clip plate (2) can either be arch-plated (as shown in FIG. 1,3) for better appearance or straight-plated (not shown in figures)for ease of use.

Figure 5:
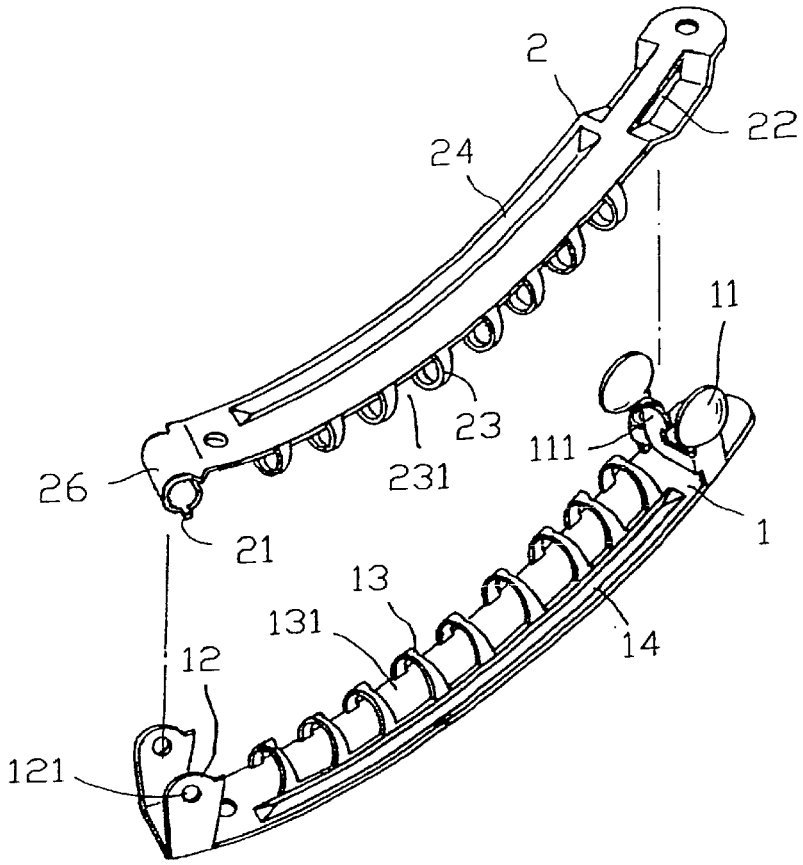
FIG. 5 is another three-dimensional decomposition of $2^{nd}$ application of present Invention.
Figure 6:
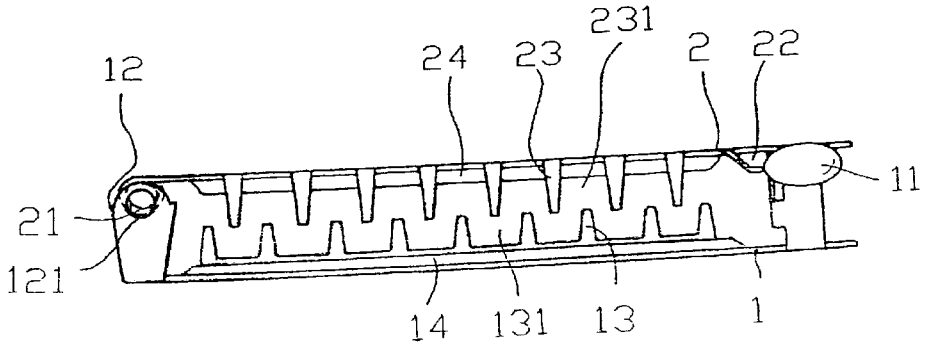
FIG. 6 is an end view of FIG. 5.

FIG. 5 is similar to FIG. 3 by that curved strips (13),(23) are staggered (as shown in FIG. 6) to prevent hair clip from falling out as it clips hairs (5) between pressure strips (23)(13). The difference is that one end of upper clip plate (2) is replaced by circular body (26) (as shown in FIG. 5, 6) which equips with pivot pins (21) on the sides. Such pins connect to coupling holes (121) of base plate (1) and form a proximate circular linear attachment between outer surface of circular body (26) and pivot plate (12). Such attachment prevents base plate (1) from detaching and also allows upper clip plate (2) to open and close smoothly.

Figure 7:
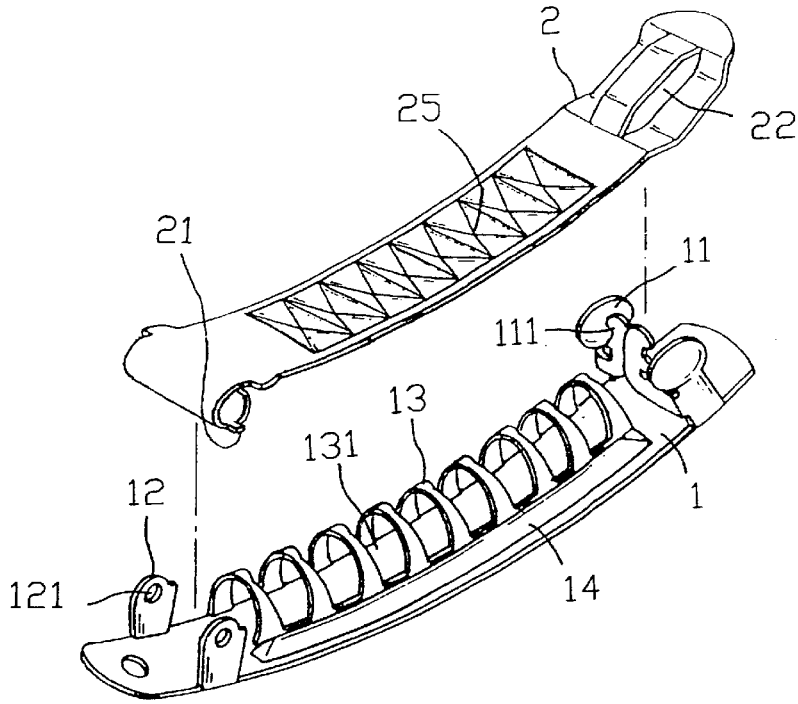
FIG. 7 is a three-dimension decomposition of $3^{rd}$ application of present invention.
Figure 8:
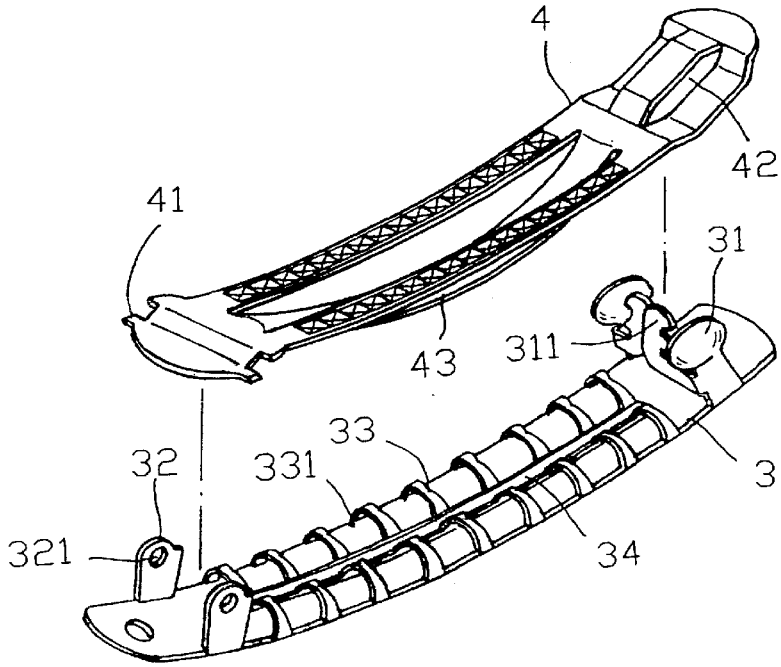
FIG. 8 is a three-dimensional decomposition of $4^{th}$ application of present invention.
Figure 9:
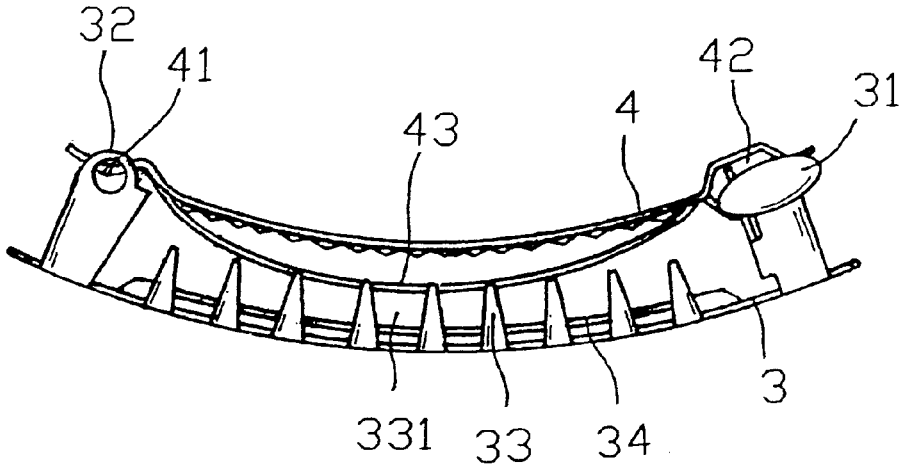
FIG. 9 is an end view of FIG. 8.
Figure 10:
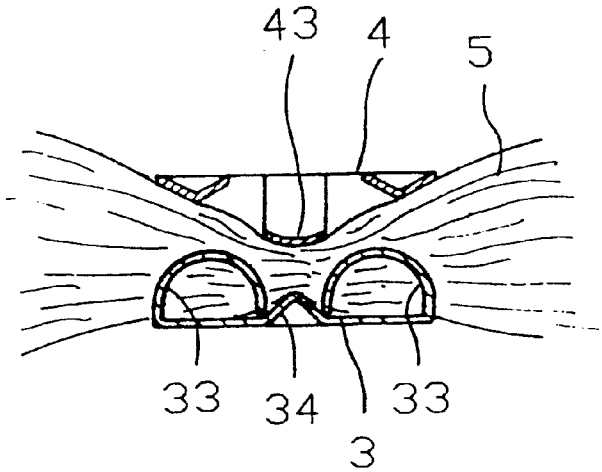
FIG. 10 demonstrates $4^{th}$ application of present invention in using state.
Figure 11:
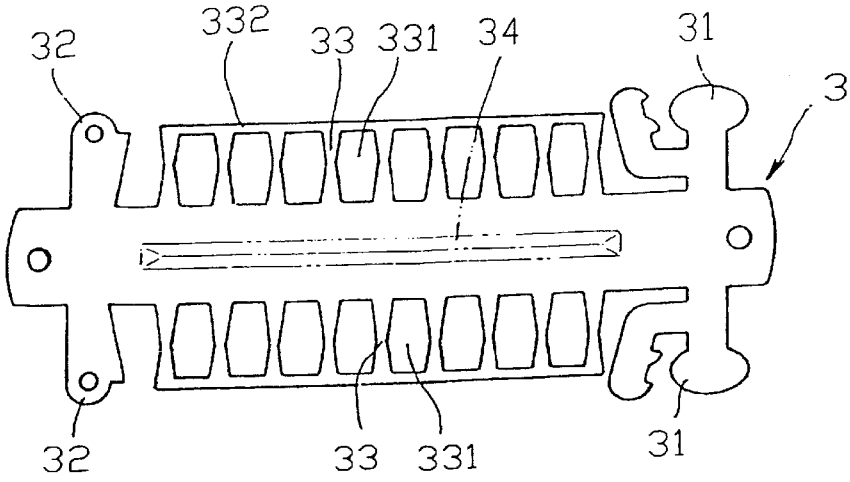
FIG. 11 is a stretch view of base plate of $4^{th}$ application of present invention.

FIG. 7 illustrates $3^{rd}$ application of present invention. It is different from $1^{st}$ application by that support strip (24) is replaced by multiple downwardly convex tapers (25) located at the center of upper clip plate (2). Such tapers can tightly press hairs (5) into rooms (131) of curved strips (13) and prevents hairclip from falling out.

FIGS. 8 to 11 illustrate $4^{th}$ application of present invention. It is different from $1^{st}$ application by that two series of curved strips (33) are equipped on base plate (3). Each series is separated by support strip (34) at the center of base plate (3). One end of both series of curved strips (33) is connection strips (332) which reach against the sides of support strip (34). Finally, a curved pressure strip (43) is equipped at the center of the upper clip plate (4).

In actual using state, curved pressure strip (43) would allocate hairs (5) evenly into rooms (331) between curved strips (33) of base plate (3). Consequently contact area is increased and hairs (5) are clipped evenly and tightly, and are also protected against twisting and damage. In actual application, placement of connection strip (332) can is optional.

Figure 12:
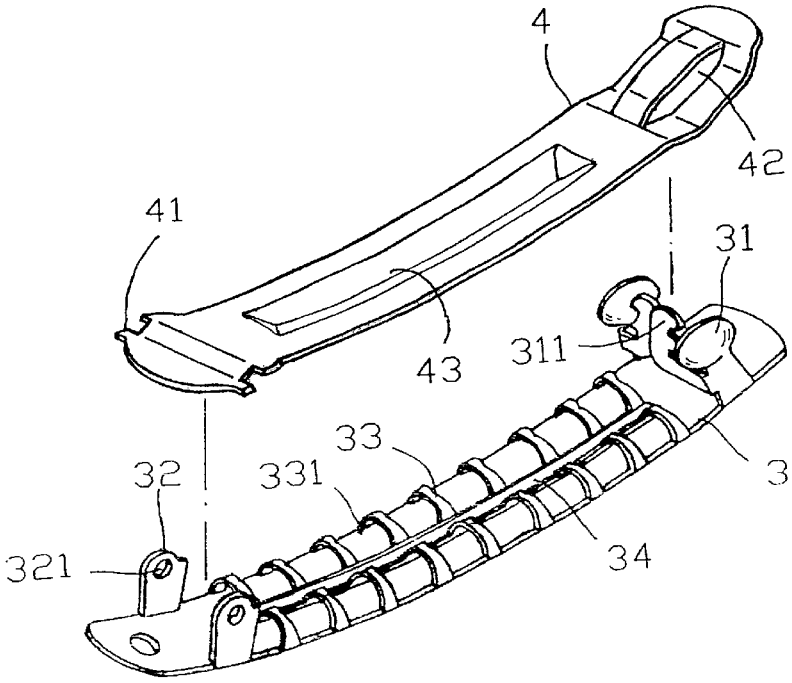
FIG. 12 is a three-dimensional decomposition of $5^{th}$ application of present invention.
Figure 13:
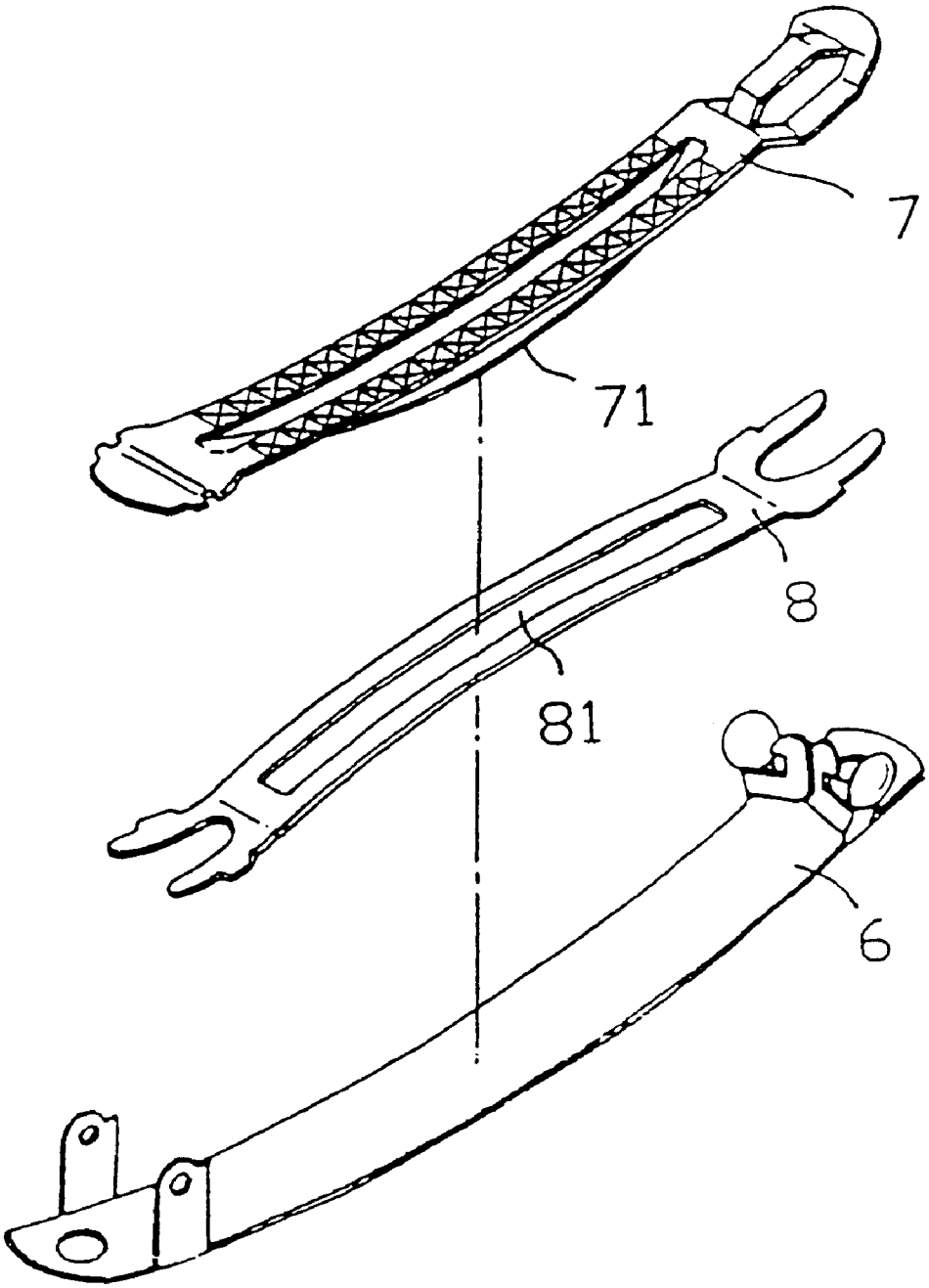
FIG. 13 Prior Art
FIG. 13 is a three-dimensional decomposition of common hair clip.
Figure 14:
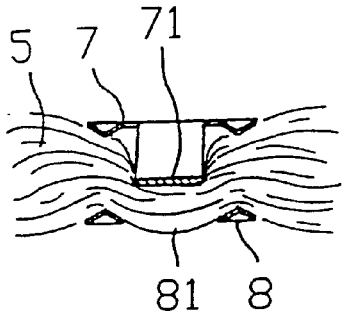
FIG. 14 Prior Art
FIG. 14 is a three-dimensional assemble view of common hair clip.
Figure 15:
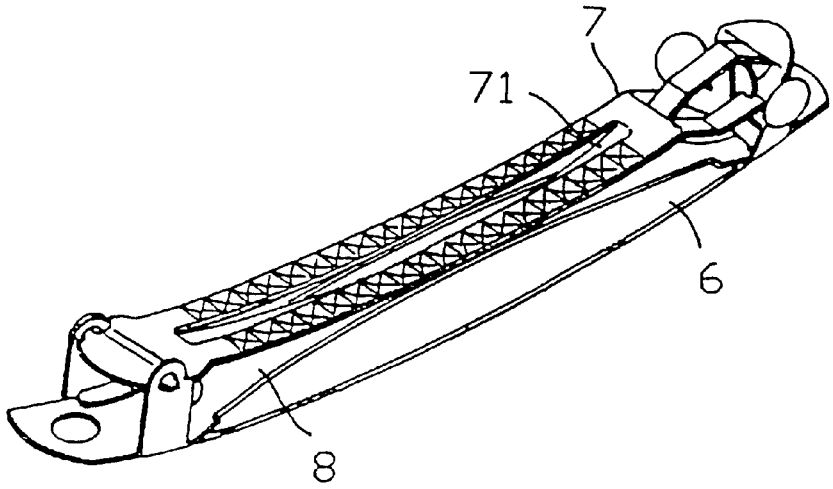
FIG. 15 Prior Art
FIG. 15 is a cross-sectional view of common hair clip as it clips strands of hair.

It is notable that, as described in $4^{th}$ application, the middle section of upper clip plate (4) can be narrow (not shown in figures). Furthermore, A support strip (as shown in FIG. 12) can be equipped on upper clip plate (2) to correspond to the space between curved strips (33) without reducing any clipping effect.

The applications stated above are for illustrative purposes and will not restrict the scope of the patent to be claimed. Any structural modifications utilizing the manual or figures of present invention are within the scope of the invention.

What is claimed is:

1. A hair clip, comprising:

a longitudinally extended base plate having a pair of pressure strips adjacent one longitudinal end thereof, each of said pressure strips having a hook extending inwardly therefrom, said base plate having a pair of pivot plates disposed at an opposing longitudinal end thereof, each of said pivot plates having a coupling hole formed therein;

a longitudinally extended upper clip plate having a pair of pivot pins adjacent a first longitudinal end thereof respectively engaged within said coupling holes of said pivot plates, said upper clip plate having a pair of buckling holes formed adjacent an opposing second longitudinal end thereof; and, a hair allocation mechanism including a plurality of longitudinally spaced arcuate strips disposed on said base plate in at least one row to form a plurality of rooms therebetween, each of said arcuate strips extend in a direction transverse said longitudinal direction between two transversely spaced portions of said base plate.

2. The hair clip as recited in claim 1, wherein said plurality of arcuate strips are symmetrically disposed in two rows respectively disposed on opposing transverse sides of said base plate and said hair allocation mechanism further includes a longitudinally extending arcuate pressure strip centrally disposed on said upper clip plate for tightly clipping hair.

3. The hair clip as recited in claim 2, wherein said plurality of arcuate strips of each of said rows each have one end coupled to a respective one of a pair of connection strips and said base plate has a first support strip centrally formed therein, said pair of connection strips each being disposed in contact with a corresponding side of said first support strip.

4. The hair clip as recited in claim 3, wherein said hair allocation mechanism further includes a second support strip extending from a lower side of said upper clip plate and in correspondence with said first support strip for tightly clipping hair between said upper clip plate and said base plate.

5. The hair clip as recited in claim 1, wherein said plurality of arcuate strips each have one end coupled to a connection strip and said base plate has a support strip formed therein, said connection strip being disposed in contact with said support strip.

6. The hair clip as recited in claim 5, wherein said hair allocation mechanism further includes a downwardly convex curved strip extending from a lower side of said upper clip plate and in correspondence with said support strip for tightly clipping hair between said upper clip plate and said base plate.

7. The hair clip as recited in claim 1, wherein said upper clip plate has a circular body formed at said first end thereof, said pair of pivot pins respectively extending from opposing ends of said circular body to provide a circular linear attachment of said upper clip plate to said base plate.

8. The hair clip as recited in claim 1 or 7, wherein said hair allocation mechanism further includes a plurality of longitudinally spaced downwardly convex arcuate strips disposed on a lower side of said upper clip plate, said downwardly convex arcuate strips of said upper clip plate being disposed interdigitated relationship with said spaced arcuate strips of said base plate.

9. The hair clip as recited in claims 1 or 7, wherein said hair allocation mechanism further includes a plurality of longitudinally spaced downwardly convex tapers disposed on a lower side of said upper clip plate for tightly clipping hair within said plurality of rooms.

10. A hair clip, comprising:

a longitudinally extended base plate having a pair of pressure strips adjacent one longitudinal end thereof, each of said pressure strips having a hook extending inwardly therefrom, said base plate having a pair of pivot plates disposed at an opposing longitudinal end thereof, each of said pivot plates having a coupling hole formed therein;

a longitudinally extended upper clip plate having a circular body formed at a first longitudinal end thereof, said circular body having a pair of pivot pins extending therefrom and respectively engaged within said coupling holes of said pivot plates to provide a circular linear pivotal attachment of said upper clip plate to said base plate, said upper clip plate having a pair of buckling holes formed adjacent an opposing second longitudinal end thereof; and, a plurality of longitudinally spaced arcuate strips disposed on said base plate to form a plurality of rooms therebetween, each of said arcuate strips extend in a direction transverse said longitudinal direction.

* * * * *